US008640741B2

(12) United States Patent
Barrett et al.

(10) Patent No.: US 8,640,741 B2
(45) Date of Patent: Feb. 4, 2014

(54) WOVEN PAPERMAKER FABRIC, IN PARTICULAR A FORMING FABRIC

(71) Applicant: Heimbach GmbH & Co. KG, Duren (DE)

(72) Inventors: Rex Barrett, Neenah, WI (US); Alister John Rigby, Lancashire (GB)

(73) Assignee: Heimbach GmbH & Co. KG, Duren (DE)

( * ) Notice: Subject to any disclaimer, the term of this patent is extended or adjusted under 35 U.S.C. 154(b) by 0 days.

(21) Appl. No.: 13/655,018

(22) Filed: Oct. 18, 2012

(65) Prior Publication Data

US 2013/0098497 A1 Apr. 25, 2013

(30) Foreign Application Priority Data

Oct. 22, 2011 (EP) ..... 11008488

(51) Int. Cl.
*D21F 1/10* (2006.01)
*D03D 25/00* (2006.01)

(52) U.S. Cl.
USPC ..... 139/383 A; 139/383 R; 139/383 AA; 139/408; 162/358.2

(58) Field of Classification Search
USPC ..... 139/383 R, 383 A, 383 AA, 408; 162/358.2
See application file for complete search history.

(56) References Cited

U.S. PATENT DOCUMENTS

| | | | | | |
|---|---|---|---|---|---|
| 4,554,953 | A * | 11/1985 | Borel et al. | ..... | 139/383 A |
| 4,564,051 | A * | 1/1986 | Odenthal | ..... | 139/425 A |
| 4,856,562 | A * | 8/1989 | Dufour | ..... | 139/383 A |
| 5,052,448 | A * | 10/1991 | Givin | ..... | 139/383 A |
| 5,152,326 | A * | 10/1992 | Vohringer | ..... | 139/383 A |
| 7,089,968 | B2 * | 8/2006 | Aldrich | ..... | 139/383 A |
| 7,874,322 | B2 | 1/2011 | Ueda | | |
| 8,252,146 | B2 | 8/2012 | Boeck et al. | | |
| 2003/0217782 | A1 | 11/2003 | Nagura et al. | | |
| 2004/0216798 | A1 * | 11/2004 | Aldrich | ..... | 139/383 A |
| 2008/0035230 | A1 * | 2/2008 | Danby et al. | ..... | 139/383 A |
| 2010/0252137 | A1 | 10/2010 | Ueda | | |
| 2011/0011485 | A1 | 1/2011 | Ueda | | |

FOREIGN PATENT DOCUMENTS

| | | | |
|---|---|---|---|
| DE | 7630882 | U1 | 3/1977 |
| DE | 29807274 | U1 | 7/1998 |
| EP | 0263482 | A1 | 4/1988 |
| EP | 1365066 | A1 | 11/2003 |
| EP | 1605095 | A1 | 12/2005 |

(Continued)

OTHER PUBLICATIONS

Examination Report, mailed Oct. 15, 2013, and English translation for corresponding Japanese Patent Application No. 223089/12.

*Primary Examiner* — Bobby Muromoto, Jr.
(74) *Attorney, Agent, or Firm* — Berenato & White, LLC

(57) ABSTRACT

A woven papermaker fabric having a first woven fabric layer made of first threads and having a second woven fabric layer made of second threads, the two woven fabric layers being connected by binder threads formed by structural second threads at binder points and having knuckles having peaks constituting a peak plane parallel to a paper side plane, and the first threads forming knuckles with concave inner bends, the points of which lying nearest to the paper side plane constituting an inner plane, wherein the tension of the first threads extending transversely to the binder threads is such that the peak plane is nearer to the paper side plane than the inner plane thereby causing lateral deflections of at least one of the first threads.

20 Claims, 4 Drawing Sheets

(56) References Cited

FOREIGN PATENT DOCUMENTS

| | | | |
|---|---|---|---|
| EP | 2314762 | A1 | 4/2011 |
| JP | 49010281 | | 1/1974 |
| JP | 62078294 | A | 4/1987 |
| JP | 62-097994 | A | 5/1987 |
| JP | 2001248086 | A | 9/2001 |
| JP | 2002013087 | A | 1/2002 |
| JP | 2004068168 | A | 3/2004 |
| JP | 2008133570 | A | 6/2008 |
| JP | 2010511805 | A | 4/2010 |
| JP | 2010126847 | A | 6/2010 |
| JP | 2010126848 | A | 6/2010 |
| WO | 98/37273 | A1 | 8/1998 |
| WO | 2009044914 | A1 | 4/2009 |

* cited by examiner 73
71
34
70
73
36
73
38
40
73
42
73
44
73
72
74
75
58
32
4
46
35
37
39
41
43
45
3
33
47
48
49
50
51
52
53
54
55
56
57

31
32
49
50
51
65
53
54
70
71
58
73
61
46
47
63
59
48
60
2
4
6
66
8
56
10
68
12
14
64
16
67
18
57
20
55
22
69
24
34
35
36
37
38
39
40
41
42
43
44
45
62
52

WOVEN PAPERMAKER FABRIC, IN PARTICULAR A FORMING FABRIC

CROSS-REFERENCE TO RELATED APPLICATIONS AND CLAIM TO PRIORITY

This application is related to application number 11 008 488.6, filed Oct. 22, 2011, in the European Patent Office, the disclosure of which is incorporated herein by reference and to which priority is claimed.

FIELD OF THE INVENTION

The invention relates to a woven papermaker fabric, in particular a forming fabric, having a first woven fabric layer forming a paper side at the outside of the fabric and made of first threads interwoven with one another which form recurring first woven repeats and a paper side plane, and having a second woven fabric layer forming a machine side at the outside of the fabric made of second threads interwoven with one another, which form recurring second woven repeats, the two woven fabric layers forming together an overall woven repeat of the fabric and being connected to one another by binder threads formed by structural second threads belonging to the second woven repeats at binder points, where one binder thread and one first thread bind one first thread running transversely thereto on its paper side, the binder threads forming knuckles at the binder points having peaks on their paper side constituting a peak plane parallel to the paper side plane, and the first threads forming knuckles on the paper side with concave inner bends, the points of which lying nearest to the paper side constituting an inner plane parallel to the paper side plane.

BACKGROUND OF THE INVENTION

Woven papermaker fabrics are intended to be used in the sections of a paper making machine as a support for the paper web. They are endless woven fabrics or fabrics made endless by means of a seam which circulate in the paper making machine. In the first section of a paper making machine, forming fabrics are used, on the top strand of which a paper pulp is disposed at the start, and the latter is dewatered through the forming fabric such as to form a paper web, wherein the dewatering is supported in particular by suction boxes disposed on the under or inner side of the fabric.

A papermaker fabric must have a fine structure on the paper side in order to support and retain a high percentage of the deposited paper fibers. On the other hand, the machine side of such a fabric must be durable enough to withstand wear and give adequate life, strong enough to resist tensile forces and open enough to provide drainage. Meeting these criteria generally requires that at least two fabric layers are superimposed utilizing threads of different size and/or count per cm and differing weave patterns.

Generally known are three types of papermakers fabrics used for the forming section of a papermaker machine. A first type is constructed of an upper and a lower layer out of transverse threads, the threads of both layers are superposed in pairs. The fabric layers are connected by longitudinal threads mostly interwoven in the upper layer and only a portion of them additionally interwoven in the lower layer, the threads of which are preferably of a larger thickness than the longitudinal threads. Such kind of forming fabrics are commonly called double-layer fabrics.

The second type of fabrics is created from two distinct fabrics, one having the qualities desired for the paper side and the other the qualities desired for the machine side. The two fabrics are stitched or bound together by additional or independent binding yarns, which do not belong to the recurring woven fabric repeats formed by the longitudinal and transverse threads of both layers. This type of papermaker fabric is commonly called a triple-layer fabric.

The third type of papermaker fabric is based on the second type, i.e. has two distinct fabric layers comprising longitudinal and transverse threads interwoven with one another respectively. Unlike the triple-layer fabrics, this type of fabric has no additional or independent binder threads. The connection of the two layers is made of their own threads, i.e. by so-called "structural", "intrinsic" or "fabric-born" threads. These are threads which are an integral part of the weave pattern of the fabric or its woven fabric repeats. Composite fabrics of these types are commonly called SSB (sheet support binder) fabrics.

The differences between the foregoing three types of fabrics are also described in U.S. Pat. No. 5,152,326, columns 1 and 2, U.S. Pat. No. 5,052,448, columns 1 through 3 and U.S. Pat. No. 4,554,953, columns 1 through 3.

Papermaker fabrics of the SSB composite type are known, wherein the connection between the two layers is achieved by a number of structural binding thread pairs, the binding of the one binding thread in one layer is continued by the other binding thread of the binding thread pair, if the one binding thread changes from one layer to the other layer in a symmetrical manner (U.S. Pat. No. 5,152,326, US 2008/0035230 A1, EP 1 605 095 A1 and EP 1 365 066 A1). Also known are embodiments of composite papermaker fabrics, wherein the two layers are connected by structural binder threads belonging to the first woven fabric layer (U.S. Pat. No. 5,052,448; U.S. Pat. No. 4,554,953; EP 2 314 762 A1, U.S. Pat. No. 4,564,051, JP 49010281 B, DE 298 07 274 U1 and EP 1 365 066 A1). In the latter document, an embodiment is also disclosed, wherein the two layers are connected by binding threads of the second woven fabric layer forming the machine side layer.

In the figures of JP 62078294 A, a papermaker fabric is disclosed having a first woven fabric layer provided for the paper side and made of first longitudinal and first transverse threads interwoven with one another and having a second woven fabric layer provided for the machine side made of second longitudinal and second transverse threads interwoven with one another. The two woven fabric layers are connected to one another by binder threads at binder points formed by structural second threads running along and below associated first threads.

Both the binder threads and the associated first threads bind first threads of the first woven fabric layer running transversely thereto at the binder points on their paper side wherein the binder threads and also the first threads form knuckles at the binder points. The knuckles of the binder threads have peaks on their paper side, all of which constitute a peak plane parallel to the paper side. The knuckles of the associated first threads have concave inner bends, the points of which lying nearest to the paper side constitute an inner plane parallel to the paper side. The tension of the first thread extending transversely to the binder threads is such that the inner plane as defined above is nearer to the paper side or at most in the same level as the peak plane so that respectively, the binder threads and the associated first threads are forming superimposed pairs also at the binder points.

SUMMARY OF THE INVENTION

It is an object of the invention to design a woven papermaker fabric, in particular for use in the web formation region of the paper making machine such that the web formation on the paper side of the fabric is improved.

This object is achieved according to the invention in that the tension of the first threads extending transversely to the binder threads is such that the peak plane is nearer to the paper side than the inner plane thereby causing oscillating lateral deflections of at least one of the first threads running adjacently to the respective binder thread in the region of the binder points. It is therefore the basic idea of the invention to lift the knuckles of the binder threads by exerting an appropriate tension to the first threads extending transversely to the binder threads such that the knuckles of the binder threads push aside at least one of the adjacent first threads at the binder points thereby causing oscillating lateral deflections of these threads. Thereby, the binder threads are exposed to the paper side and impart a significantly higher resistance to drainage flow thus creating a significant improvement in web formation.

There are two general concepts of the invention. In one embodiment, the binder threads are disposed below one first thread extending in the same direction vertically stacked to one another respectively. Preferably those first threads bind the transverse threads side by side with the corresponding binder thread at the binder points forming said lateral deflections in the region of the binder points. In that case, the first threads are pushed aside by direct contact between the binder thread and first thread binding together side by side the first thread running transversely to them at the binder point.

Alternatively thereto, the binder threads and the first threads running in the same direction can be disposed offset to one another, for example by shifting the two fabric layers accordingly, if the number of second and first threads running in the same direction as the binder threads is the same. In another example, the offset can be realized by providing a number of second threads, which is lower than the number of first threads running in the same direction as the binder threads, preferably if the number of these first threads is odd and the number of these second threads is even per woven repeat or vice versa. Preferably, at the binder points, the first threads running in the same direction as the binder threads and adjacently to them on the side opposite to the side where the adjacent first threads running in the direction of the binder threads bind the transverse first threads on their paper side, pass under these transverse first threads forming said lateral deflections in the region of the binder points. Due to the offset, the first thread running in the same direction as the binder thread and adjacently to it is pushed aside having no direct contact with the binder thread, but separated by the first thread running transversely thereto and extending between the binder thread and the adjacent first thread.

The lateral deflections of the first threads should cover a path length ranging from at least 10% to at most 90% of the overall woven repeat length in the running direction of these first threads. Moreover, at least some of the lateral deflections of the first threads is up to 100% of the width of the binder threads in the fabric plane, particularly at least 10% thereof.

As it is known in the state of the art, at least some of the second threads, particularly the binder threads, should have a greater cross-sectional area in particular a greater diameter than the first threads.

However, the basic idea of the invention can also be realized if the cross-sectional area of the first and second threads is equal or reverse.

In a preferred embodiment of the invention, the binder threads bind just a single first thread extending transversely to the binder threads, and it can be sufficient to bind only one single first thread in every overall woven repeat. However, it is possible that the binder threads bind two or more first threads at one binder point or two or more single first threads in every overall woven repeat.

In a further embodiment of the invention, all the second threads extending in one direction are woven as binder threads. This does not exclude embodiments, wherein not all the second threads are woven as binder threads, for example only each second or third structural thread.

In further embodiments the first threads extending in the same direction as the binder threads and/or transversely to the latter are present in a number of threads which is at least as great as the number of threads of the second threads extending in the same direction as the latter, in particular the ratio of the numbers of threads of these first and second threads is 4:3, 3:2, 2:1, 1:1, 1:2, 2:3, 3:4. Nevertheless, other ratios are possible.

In a preferred embodiment, the first threads are interwoven with one another in a plain weave. This suggestion does not exclude weaves other than a plain weave.

In a further embodiment, the binder threads extend in the provided running direction of the woven papermaker fabric, in particular woven as warp threads. The basic idea of the invention can also be realized by binder threads extending transversely to the provided running direction.

According to the invention it is suggested that the woven papermaker fabric is woven to at least eight harnesses, in particular to the maximum of 100 harnesses.

Suitable materials for the threads are all of the synthetics which are generally used with woven papermaker fabrics, and in particular forming fabrics. It is advantageous that the threads extending in the provided running direction of the woven papermaker fabric are made of polyethyleneterephthalate (PET), polyethylenenaphtha-late (PEN) or of mixtures or copolymers of these materials. The threads extending transversely to the provided running direction should be made of PET, polyamide (PA) or mixtures or copolymers of these materials or blends of these materials with polyurethane (PU).

As regards the cross-sectional shape of the threads, all known cross-sectional shapes are possible, in particular round, oval, or rectangular cross-sections or those with different profiles. Moreover, threads are provided which are twisted or braided from at least two monofilaments or multifilaments. Finally, threads can be used which are provided with a coating, in particular made of urethane or acrylic, or using nanoparticles.

BRIEF DESCRIPTION OF THE DRAWINGS

In the drawings the invention is illustrated by means of exemplary embodiments. These show as follows.

DETAILED DESCRIPTION OF THE PREFERRED EMBODIMENT(S)

Figure 1:
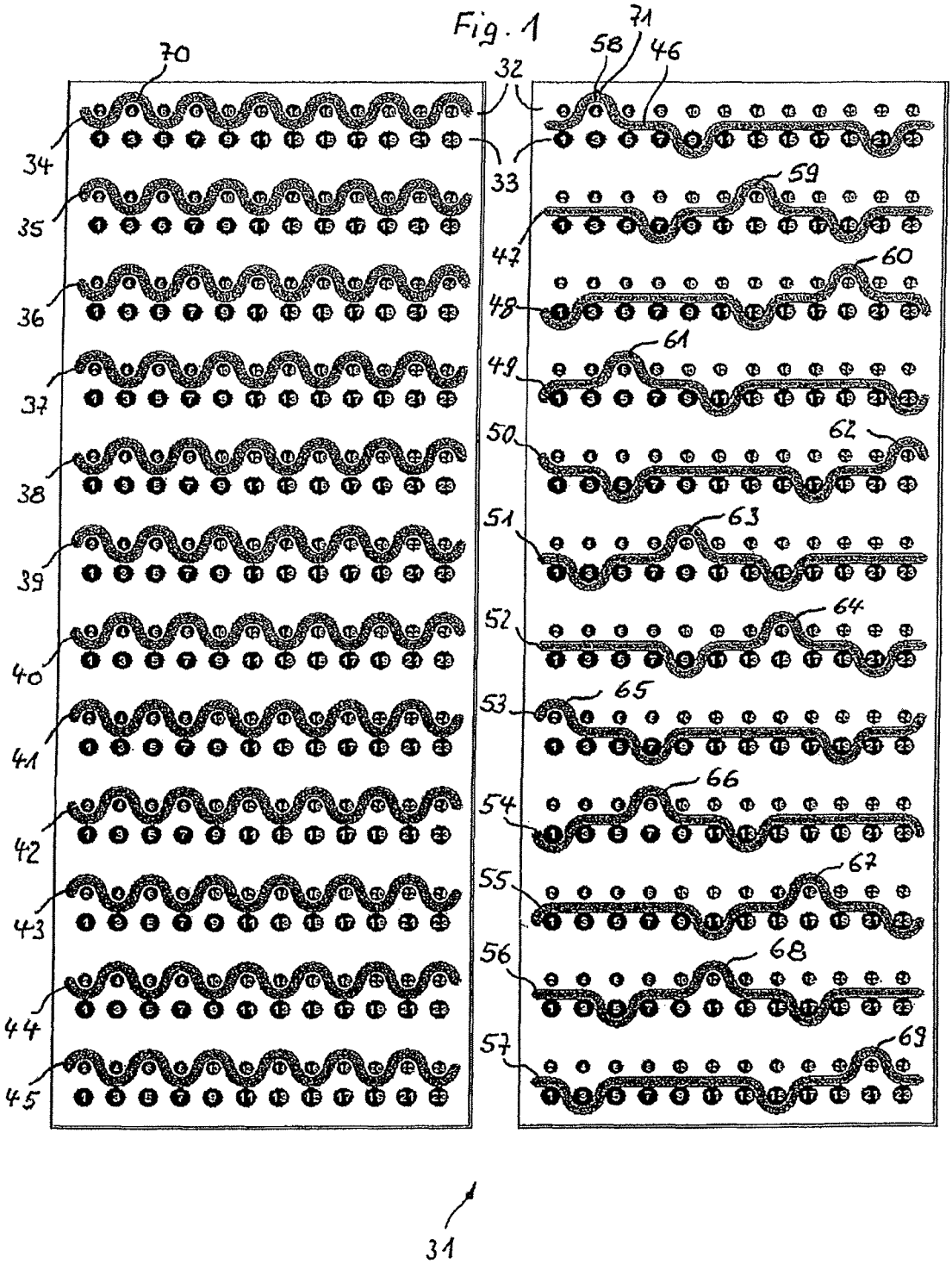
FIG. 1 twelve longitudinal cross-sections through a woven papermaker fabric in accordance with the invention showing in the left half the course and binding of twelve consecutive longitudinal first threads in the first woven fabric and in the right half the course and binding of the twelve corresponding longitudinal second threads in the second woven fabric substantially all forming binder threads.
Figure 2:
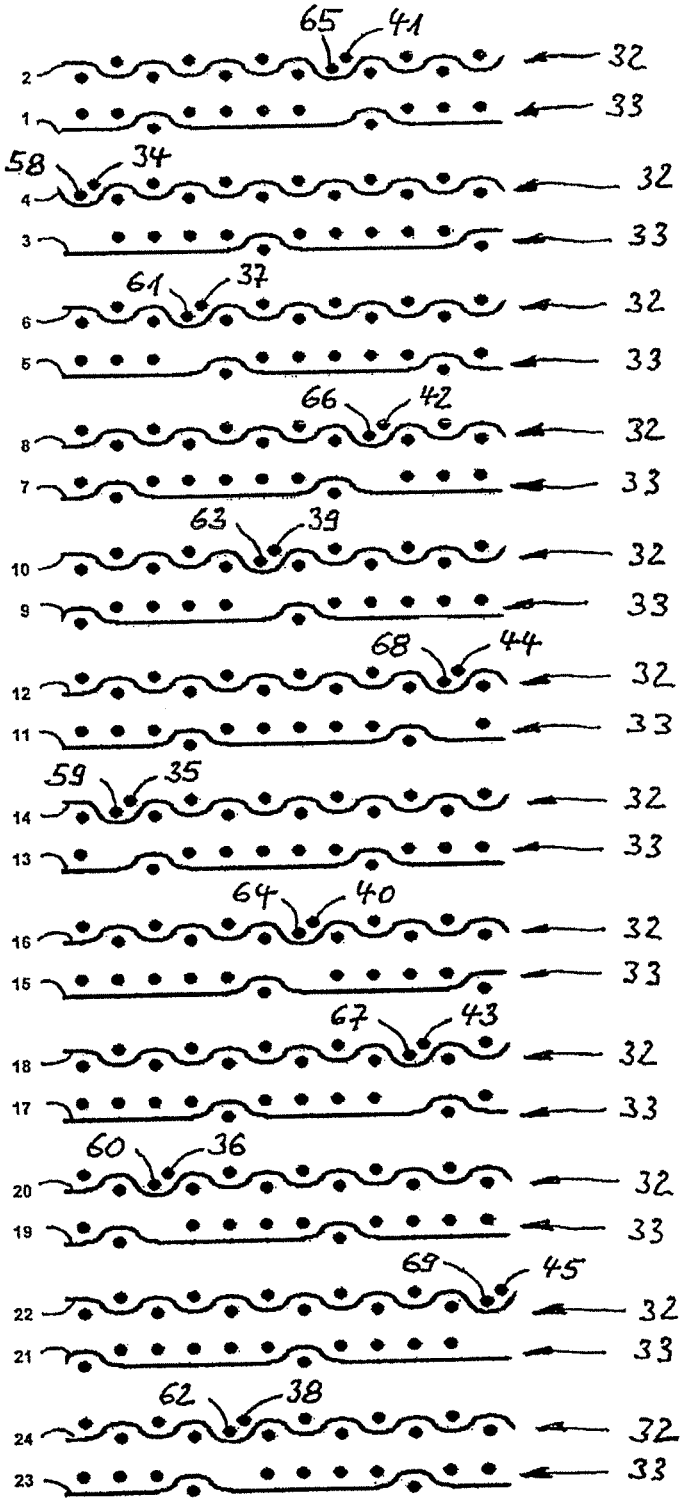
FIG. 2 twelve transverse cross-sections through the woven papermaker fabric as disclosed in FIG. 1 showing the course and binding of twelve consecutive pairs of transverse first and second threads.

FIGS. 1 and 2 show a papermaker fabric 31 for the use as a forming fabric having a first woven fabric layer 32 forming a paper side at its outside and a second woven fabric layer 33 forming a machine side at its outside. The first woven fabric layer 32 has transverse first threads in one overall pattern, which are marked with even numbers 2 to 24. These transverse first threads 2, 4, 6 . . . 24 are interwoven with longitudinal first threads 34 to 45 in a plain weave as recognizable also in FIG. 2. In this figure, the longitudinal first threads 34 to 45 are provided with reference numbers only at binder points.

The second woven fabric layer 33 is composed of transverse second threads marked with odd numbers 1 to 23. These second threads 1, 3, 5 . . . 23 are interwoven with longitudinal second threads 46 to 57 the course of which is shown in the right half of FIG. 1. The transverse second threads 1, 3, 5 . . . 23 have—as the transverse first threads 2, 4, 6 . . . 24—a round cross-section with a greater diameter than the diameter of the transverse first threads 2, 4, 6 . . . 24. The number of the transverse first threads 2, 4, 6 . . . 24 is equal to the number of the transverse second threads 1, 3, 5 . . . 23 and each transverse second thread 1, 3, 5 . . . 23 extends vertically stacked below a transverse first thread 2, 4, 6 . . . 24, respectively.

As recognizable from the right half of FIG. 1, the course of the longitudinal second threads 46 to 57 is such that one longitudinal second thread 46 to 57 floats over five consecutive transverse second threads 1, 3, 5 . . . 23, then binds one transverse second thread 1, 3, 5 . . . 23 forming a knuckle on the machine side, floats above two consecutive transverse second threads 1, 3, 5 . . . 23 and then binds one transverse first thread 2, 4, 6 . . . 24 forming a knuckle 58 to 69 on the paper side at a binder point respectively. Thereafter, this longitudinal second thread 46 to 57 floats over two consecutive transverse second threads 1, 3, 5 . . . 23 and then binds another transverse second thread 1, 3, 5 . . . 23 on the machine side. Since all of the longitudinal second threads 1, 3, 5 . . . 23 bind transverse first threads 2, 4, 6 . . . 24, they all function as binder threads.

As shown in FIG. 2, one transverse second thread 1, 3, 5 . . . 23 floats in one repeat under five longitudinal second threads 46 to 57 on the machine side, then binds one longitudinal second thread 46 to 57 on the other side and then floats under five longitudinal second threads 46 to 57. In this figure, the longitudinal second threads 46 to 57 are characterized only by the reference numbers of their knuckles 58 to 69 at the binder points.

In the direction transverse to the provided running direction of the papermaker fabric 31, each longitudinal first thread 34 to 45 is extending above a longitudinal second thread 46 to 57 respectively forming pairs (34 and 46, 35 and 47, etc.) consisting of one longitudinal second thread 46 to 57 forming a binder thread and one longitudinal first thread 34 to 45.

At each binder point, one longitudinal second thread 46 to 57 binds a transverse first thread 2, 4, 6 . . . 24 on the paper side together side by side with one longitudinal first thread 34 to 45. Referring to FIG. 1, for example longitudinal second thread 46 binds the transverse first thread 4 forming a knuckle 58 together with the associated longitudinal first thread 34 forming a knuckle 70. In FIG. 2 this situation is recognizable of the second cross-section counted from above showing the transverse first thread 4 and the transverse second thread 3. The tension of the transverse first threads 2, 4, 6 . . . 24 is so strong that at the binder points the longitudinal second threads 46 to 57 are lifted into the plane of the first woven fabric layer 32 such that the respective adjacent longitudinal first threads 34 to 45 are pushed aside laterally from their position exactly above the corresponding longitudinal second thread 46 to 57 to a position obliquely above that second thread 46 to 57. Contrary to the drawing in FIG. 2, these longitudinal first threads 34 to 45 are of course in contact with the respective longitudinal second threads 46 to 57 at the binder points.

Figure 3:
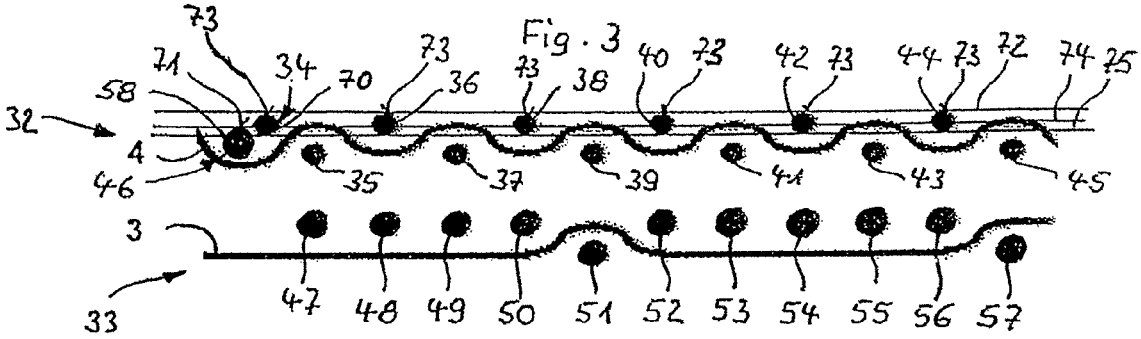
FIG. 3 the second transverse cross-section of FIG. 2 in an enlarged representation.

FIG. 3 shows an enlarged representation of the second transverse cross-section in FIG. 2 counted from above. The transverse first thread 4 is bound in a knuckle 58 of the longitudinal second thread 46 on the paper side together with the knuckle 70 of longitudinal first thread 34 at a binder point. The knuckle 58 forms a peak 71 lying nearest to a paper side plane 72 constituted by outer peaks 73 of the longitudinal first threads 34 to 45. Each knuckle 58 to 69 has such a peak 71, and all the peaks 71 form a peak plane 74. Another plane is formed by the paper side knuckles of the longitudinal first threads 34 to 45, namely by points of their concave inner bends lying nearest to the paper side and constituting an inner plane 75. FIG. 3 shows that the peak plane 74 is nearer to the paper side plane 72 than the inner plane 75 as defined above thereby causing lateral displacement of the longitudinal first threads 34 to 45 by the longitudinal second threads 46 to 57 at each binder point.

Figure 4:
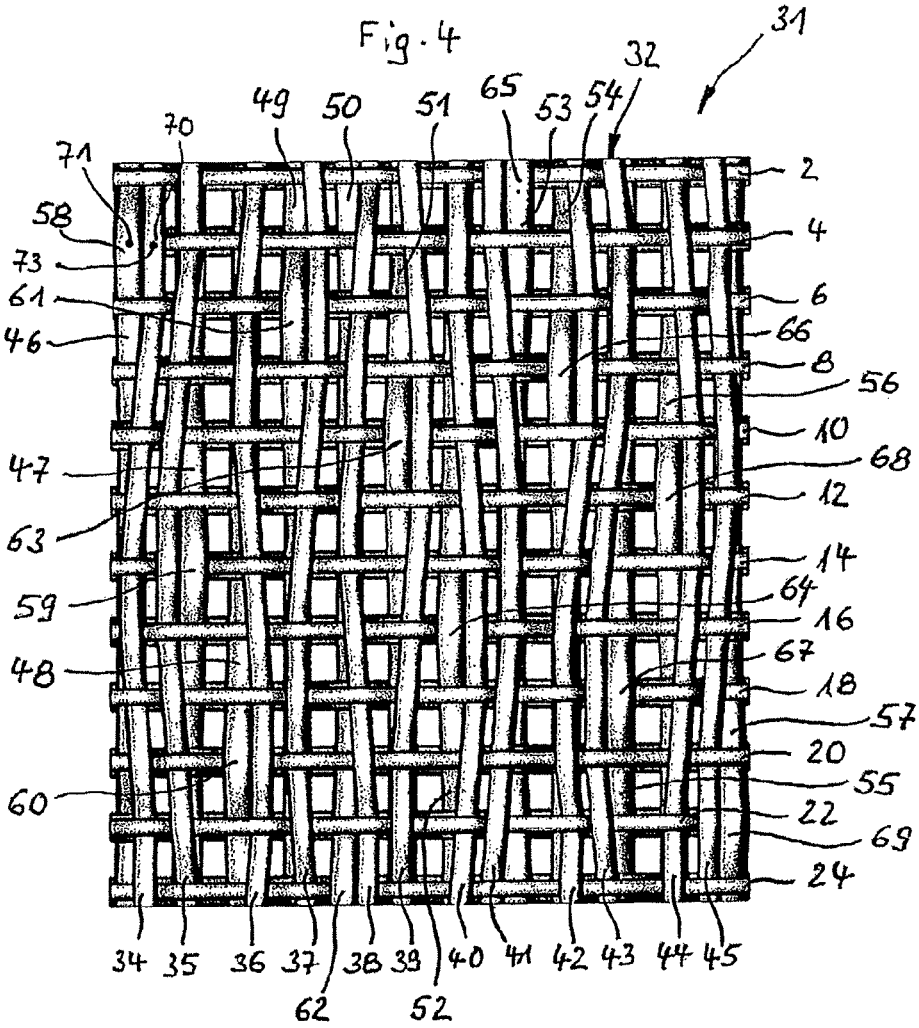
FIG. 4 a top view of the woven papermaker fabric as shown in FIGS. 1 to 3.

FIG. 4 shows the paper side of the papermaker fabric 31. The first woven fabric layer 32 is composed of the transverse first threads 2, 4, 6 . . . 24 interwoven with longitudinal first threads 34 to 45. At the binder points longitudinal second threads 46 to 57 run over one transverse first thread 2 to 24 respectively forming knuckles 58 to 69 thereby pushing the associated longitudinal first threads 34 to 45 laterally so that the longitudinal second threads 46 to 57 are exposed to the paper side imparting a resistance to drainage flow and supporting the web formation. It is recognizable that the longitudinal first threads 34 to 45 oscillate forming lateral deflections in the surrounding of a binder point. Between two consecutive binder points, the longitudinal first threads 34 to 45 return to a position exactly above the corresponding longitudinal second thread 46 to 57. Moreover, this recognizable that at the binder points, the longitudinal first threads 34 to 45 are sometimes deflected to the left side of the corresponding longitudinal second thread 46 to 57 (see for example the binder points formed by knuckles 59, 65, 67 and 69) and sometimes to the right side (for example at the binder points formed by the knuckles 58, 60, 61, 62, 63, 64, 66, 68).

Figure 5:
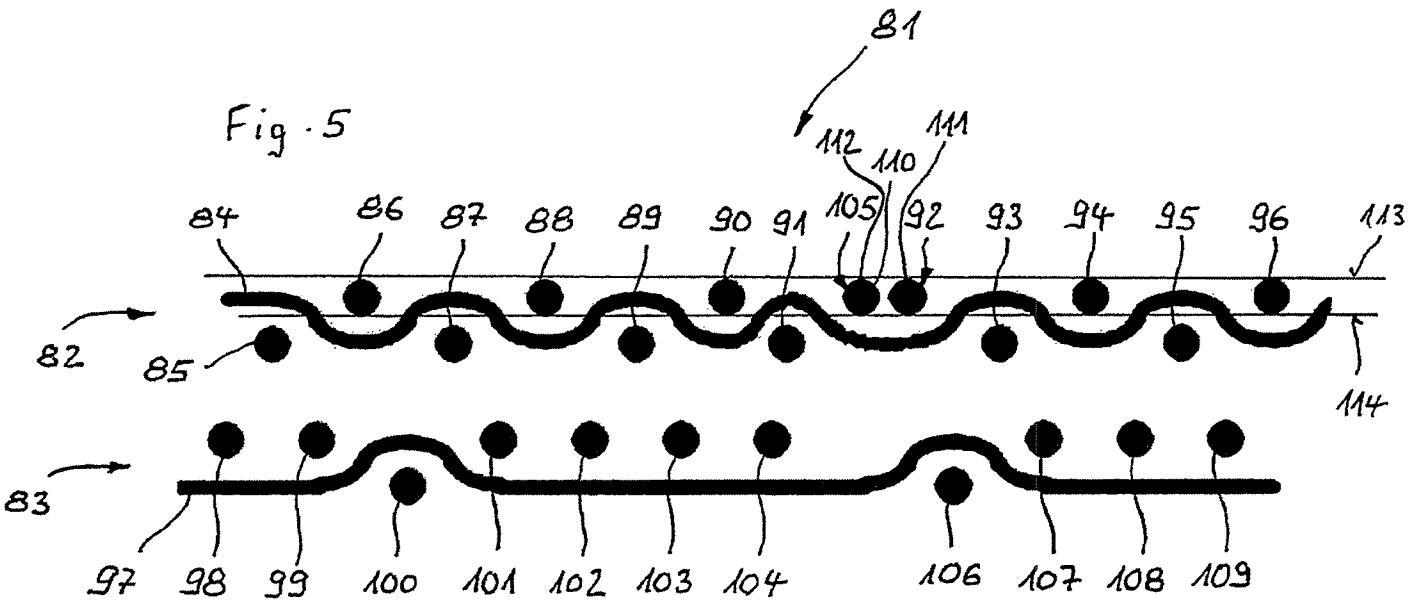
FIG. 5 a transverse cross-section through another embodiment of the woven papermaker fabric in accordance with the invention showing the course and binding of transverse first and second threads.

FIG. 5 shows a similar papermaker fabric 81 in the same cross-section plane as the first cross-section in FIG. 2 counted from above. It has a first woven fabric layer 82 forming a paper side at its outside and a second woven fabric layer 83 forming a machine side at its outside. The first woven fabric layer 82 has transverse first threads 84, which are interwoven with longitudinal first threads 85 to 96 in a plain weave. The second woven fabric layer 83 is composed of transverse second threads 97 and of longitudinal second threads 98 to 109, which are interwoven in the same manner as in the second woven fabric layer 33 of the papermaker fabric 31 according to FIGS. 1 to 4.

The number of the longitudinal first threads 85 to 96 is equal to the number of the longitudinal second threads 98 to 109. However, contrary to the embodiment shown in FIGS. 1 to 4, the longitudinal first threads 85 to 96 are disposed offset to the longitudinal second threads 98 to 109, i.e. they are not vertically stacked. All the longitudinal second threads 98 to 109 form binder threads binding the transverse first threads 84 in the same manner as in the papermaker fabric 31 so that the course of the longitudinal second threads 98 to 109 is the same as disclosed on the right half of FIG. 1.

At each binder point, one longitudinal second thread 98 to 109 binds a transverse first thread 84 on the paper side together and side by side with a longitudinal first thread 85 to 96. In FIG. 5, it is recognizable a binder point, where the longitudinal second thread 105 binds the transverse first thread 84 on the paper side forming a knuckle 110 together with the adjacent longitudinal first thread 92 forming a knuckle 111 on the paper side as well. The tension of the transverse first thread 84 is so strong that the longitudinal second thread 105 is lifted into the plane of the first woven fabric layer 82 such that the knuckles 110, 111 of the longitudinal first and longitudinal second threads 92, 105 are substantially in the same level.

Contrary to the embodiment of the papermaking fabric 31 disclosed in FIGS. 1 to 4, the longitudinal first thread 92 is not pushed aside by the longitudinal second thread 105. The reason is the offset of the two fabric layers 82, 83. This causes that the float of the transverse first thread 84 under the longitudinal first and second threads 92, 105 is extended resulting in pushing aside the longitudinal first thread 91 running invertedly with respect to the longitudinal first thread 92 laterally from its normal position in a position almost above the longitudinal second thread 104. This repeats at each binder point, where the first and second longitudinal threads 92, 105 bind a transverse first thread.

The knuckle 110 of the longitudinal second thread 105 forms a peak 112 lying nearest to a paper side plane 113 constituted by the outer peaks of the longitudinal first threads 85 to 96. Each longitudinal second thread 98 to 109 has such a peak 112 at the binder points, and all these peaks 112 form a peak plane, which is in this embodiment identical with the paper side plane 113.

Another plane is formed by the paper side knuckles of the longitudinal first threads 85 to 96, namely by points of their concave inner bends lying nearest to the paper side and constituting an inner plane 114. FIG. 5 shows that the inner plane 114 has a distance to the paper side plane 113 being identical with the peak plane defined by the peaks 112 of the longitudinal second threads 98 to 109.

The present invention has been described herein in terms of one or more preferred embodiments. However, it should be understood that numerous modifications and variations to these embodiments would be apparent to those skilled in the art upon a reading of the foregoing description. Therefore, it is intended that any such modifications and variations comprise a part of this invention, provided they come within the scope of the following claims and their equivalents.

I claim:

1. A woven papermaker fabric (31, 81), in particular a forming fabric, having a first woven fabric layer (32, 82) forming a paper side at the outside of the fabric (31, 81) and made of first threads (2, 4, 6 . . . 24; 34 to 45; 84 to 96) interwoven with one another which form recurring first woven repeats and a paper side plane (72, 113), and having a second woven fabric layer (33, 83) forming a machine side at the outside of the fabric made of second threads (1, 3, 5 . . . 23; 46 to 57, 97 to 109) interwoven with one another, which form recurring second woven repeats, the two woven fabric layers (32, 33; 82, 83) forming together an overall woven repeat of the fabric (31, 81) and being connected to one another by binder threads formed by structural second threads (46 to 57, 98 to 109) belonging to the second woven repeats at binder points, where one binder thread and one first thread (34 to 45; 85 to 96) running adjacently in the same direction bind a first thread (2, 4, 6 . . . 24; 84) running transversely thereto side by side on its paper side respectively, the binder threads forming knuckles (58 to 69; 110) at the binder points having peaks (71, 112) on their paper side constituting a peak plane (74) parallel to a paper side plane (72, 113), and the first threads forming knuckles (73, 111) on the paper side with concave inner bends, the points of which lying nearest to the paper side plane (72, 113) constituting an inner plane (75, 114) parallel to the paper side plane (72, 113), characterized in that the tension of the first threads (2, 4, 6 . . . 24; 84) extending transversely to the binder threads is such that the peak plane (74) is nearer to the paper side plane (72, 113) than the inner plane (75, 114) thereby causing oscillating lateral deflections of at least one of the first threads (34 to 45; 85 to 96) running adjacently to and in the same direction as the respective binder thread in the region of the binder points.

2. The woven papermaker fabric according to claim 1, characterized in that the binder threads are disposed below one first thread (34 to 45) extending in the same direction vertically stacked to one another respectively, preferably that those first threads (34 to 45) bind the transverse threads side by side with the corresponding binder thread at the binder points forming said lateral deflections in the region of the binder points.

3. The woven papermaker fabric according to claim 1, characterized in that the binder threads and the first threads (85 to 96) running in the same direction are disposed offset to one another, preferably that at the binder points, the first threads (85 to 96) running in the same direction as the binder threads and adjacently to them on the side opposite to the side, where the adjacent first threads (85 to 96) running in the direction of the binder threads bind the transverse first threads on their paper side, pass under these transverse first threads forming said lateral deflections in the regions of the binder points.

4. The woven papermaker fabric according to claim 1, characterized in that said lateral deflections of the first threads (34 to 45; 85 to 96) cover a path length ranging from at least 10% to at most 90% of the overall woven repeat length in the running direction of these first threads (34 to 45; 85 to 96).

5. The woven papermaker fabric according to claim 1, characterized in that at least some of said lateral deflections of the first threads (34 to 45; 85 to 96) is up to 100% of the width of the binder threads in the fabric plane, particularly at least 10% thereof.

6. The woven papermaker fabric according to claim 1, characterized in that at least some of the second threads (1, 3, 5 . . . 23; 46 to 57; 97 to 109), particularly the binder threads have a greater cross-sectional area than the first threads (2, 4, 6 . . . 24; 34 to 45; 84 to 96).

7. The woven papermaker fabric according to claim 1, characterized in that the binder threads bind just a single first thread (2, 4, 6 . . . 24; 84) in every overall woven repeat.

8. The woven papermaker fabric according to claim 1, characterized in that all the second threads (46 to 57; 98 to 109) extending in one direction are woven as binder threads.

9. The woven papermaker fabric according to claim 1, characterized in that the first threads (34 to 45; 85 to 96) extending in the same direction as the binder threads and/or transversely (2, 4, . . . 6 . . . 24; 84) to the latter are present in a number of threads which is at least as great as the number of the second threads (46 to 47; 97 to 109) extending in the same direction as the latter, in particular the ratio of the numbers of threads of these first and second threads (34 to 45; 2, 4, 6 . . . 24; 46 to 57; 85 to 109) is 4:3, 3:2, 2:1, 1:1, 1:2, 2:3, 3:4.

10. The woven papermaker fabric according to claim 1, characterized in that the first threads (2, 4, 6 . . . 24; 34 to 45; 84 to 96) are interwoven with one another in a plain weave.

11. The woven papermaker fabric according to claim 1, characterized in that the binder threads bind at least two second threads (1, 3, 5 . . . 23, 97) extending transversely to the binder threads in every overall woven repeat, particularly forming a twill weave or a satin weave.

12. The woven papermaker fabric according to claim 1, characterized in that the woven papermaker fabric (31, 81) is woven to at least 8 harnesses, in particular to the maximum of 100 harnesses.

13. The woven papermaker fabric according to claim 1, characterized in that the binder threads extend in the provided running direction of the woven papermaker fabric (31, 81).

14. The woven papermaker fabric according to claim 1, characterized in that the binder threads are woven as warp threads.

15. The woven papermaker fabric according to claim 1, characterized in that the threads (34 to 45; 46 to 57; 85 to 96: 98 to 109) extending in the provided running direction of the woven papermaker fabric (31; 81) are made of PET, PEN or of mixtures or copolymers of these materials and/or the threads (1, 3, 5 . . . 23; 2, 4, 6 . . . 24; 84, 97) extending transversely to the provided running directed are made of PET, PA or mixtures or copolymers of these materials or blends of these materials with PU, and/or the threads are provided having a coating, in particular made of urethane or acrylic and/or using nanoparticles.

16. The woven papermaker fabric according to claim 2, characterized in that said lateral deflections of the first threads (34 to 45; 85 to 96) cover a path length ranging from at least 10% to at most 90% of the overall woven repeat length in the running direction of these first threads (34 to 45; 85 to 96).

17. The woven papermaker fabric according to claim 3, characterized in that said lateral deflections of the first threads (34 to 45; 85 to 96) cover a path length ranging from at least 10% to at most 90% of the overall woven repeat length in the running direction of these first threads (34 to 45; 85 to 96).

18. The woven papermaker fabric according to claim 2, characterized in that at least some of said lateral deflections of the first threads (34 to 45; 85 to 96) is up to 100% of the width of the binder threads in the fabric plane, particularly at least 10% thereof.

19. The woven papermaker fabric according to claim 3, characterized in that at least some of said lateral deflections of the first threads (34 to 45; 85 to 96) is up to 100% of the width of the binder threads in the fabric plane, particularly at least 10% thereof.

20. The woven papermaker fabric according to claim 4, characterized in that at least some of said lateral deflections of the first threads (34 to 45; 85 to 96) is up to 100% of the width of the binder threads in the fabric plane, particularly at least 10% thereof.

* * * * *